US007424851B2

(12) United States Patent
Landesman et al.

(10) Patent No.: US 7,424,851 B2
(45) Date of Patent: Sep. 16, 2008

(54) SCREEN PRINTER WITH PLATEN EQUALIZER AND METHOD OF PRINTING

(76) Inventors: David A. Landesman, 6 Fair Oaks Dr., St. Louis, MO (US) 63124; Benjamin J. Landesman, 6454 Cecil Ave., St. Louis, MO (US) 63105; Doug Seibers, 316 Frederickburg, Belleville, IL (US) 62223

( * ) Notice: Subject to any disclaimer, the term of this patent is extended or adjusted under 35 U.S.C. 154(b) by 197 days.

(21) Appl. No.: 11/533,879

(22) Filed: Sep. 21, 2006

(65) Prior Publication Data

US 2008/0072775 A1 Mar. 27, 2008

(51) Int. Cl.
*B41F 15/10* (2006.01)

(52) U.S. Cl. ..... 101/115; 101/126; 101/474

(58) Field of Classification Search ..... 101/114, 101/115, 123, 126, 474
See application file for complete search history.

(56) References Cited

U.S. PATENT DOCUMENTS

| | | | | |
|---|---|---|---|---|
| 4,606,268 | A | 8/1986 | Jaffa | |
| 4,909,142 | A * | 3/1990 | Bubley | 101/115 |
| 4,949,635 | A * | 8/1990 | Padula | 101/115 |
| 5,154,119 | A | 10/1992 | Fuqua et al. | |
| 5,438,922 | A | 8/1995 | Bubley et al. | |
| 5,626,074 | A | 5/1997 | Zelko | |
| 5,845,569 | A | 12/1998 | Tkacz et al. | |
| 6,053,101 | A | 4/2000 | Hix | |
| 6,408,745 | B1 | 6/2002 | Topolewski et al. | |

* cited by examiner

*Primary Examiner*—Leslie J Evanisko
(74) *Attorney, Agent, or Firm*—Rebecca J. Brandau; Husch Blackwell Sanders LLP

(57) ABSTRACT

A multi-station screen printing apparatus includes a base member; a plurality of platens, each for supporting a substrate to be printed, the platens mounted radially in a rotatable manner about the base member; and a plurality of print heads mounted radially and non-rotatably about the base member above the platens. A first print head is mounted in a vertically pivotable manner and a second print head is mounted in a non-pivotable manner.

12 Claims, 8 Drawing Sheets

SCREEN PRINTER WITH PLATEN EQUALIZER AND METHOD OF PRINTING

CROSS-REFERENCE TO RELATED APPLICATIONS

Not Applicable.

BACKGROUND OF THE INVENTION

1. Field of the Invention

The present invention relates generally to the field of textile printing apparatuses and more particularly, to a multi-head, carousel-type textile printing press having a vertically pivotal print head.

2. Related Art

Multi-station screen printing devices enable small printing shops to screen-print designs in multiple colors on articles such as shirts, jackets, and posters, to name but a few possible items. The substrate to be printed is supported on a flat surface called a platen while a number of print heads, each containing a different color of the design, are aligned with the platens for printing purposes. The platens are arrayed around a circle and supported by a sturdy base and pivot relative to the base for alignment with each of the separate print heads.

The print heads, on the other hand, while also being arrayed about a circle, are on some machines fixedly mounted relative to the base and the platens are rotated into position beneath each print head for printing each separate color. To print a multi-color design, each of the platens is in turn aligned with a particular print head to apply a particular color ink and is subsequently brought into contact with the print head, generally by raising the platens, whereupon the screen printing process for that particular color is performed on the article. The platen bearing the substrate is then rotated to the next print head to apply the next ink color. It follows that the number of print heads determines the number of different colors that can be combined to produce a printed design.

However, in the typical configuration for such machines there are usually fewer print heads than the number of platens for supporting the substrates, or workpieces. For example, on a printing machine having six platens there are at most five print heads. The reason for omitting one or more print head is to make it easier to add and remove substrates from the platens. The range of motion of the platens relative to the print heads is kept short in order to speed up the overall process of printing, since with a shorter range of motion the platens can move to each print head more quickly. Given this short range of motion, it is very difficult to add or remove the item to be printed from the platen when the platen is aligned with a print head. The solution therefore has been to omit one of the print heads so that the machine operator has unobstructed access to one of the platens.

The practical result of this configuration, though, is that a customer who wants to have six-color printing capability must purchase a machine with eight or more platens (similarly, a customer desiring four-color printing capability must buy a six-platen machine, etc.). However, the addition of more platens to a printing machine increases the cost and size of the machine, while many smaller print shops cannot afford the higher cost and may not have the additional space needed for the larger machine.

In another style of screen printing machine the print heads are mounted on pivoting arms, which pivot upwards between screening steps in order to allow the platens to rotationally change positions. As with the platens on the fixed head machines, the range of motion of the pivoting heads is limited in order to increase the overall speed of the screen printing process. Again, the limited range of motion of the pivoting print heads makes it difficult to add and remove articles from the platen, with the result that pivoting head printing machines also have at least one fewer print head than the number of platens, to allow unimpeded access to at least one of the platens.

What is needed is a screen printing apparatus that maximizes the number of individual colors that can be printed while minimizing the cost and size of the machine. Such an apparatus preferably allows easy addition and removal of the substrate material while maintaining a high degree of alignment between colors and rapid turnover of substrate articles, such as t-shirts, towels, banners and the like.

SUMMARY OF THE INVENTION

Accordingly, in keeping with the above advantages and goals, the invention is, briefly, a multi-station screen printing apparatus which includes a base member; a plurality of platens, each for supporting a substrate to be printed, the platens mounted radially in a rotatable manner about the base member; and a plurality of print heads mounted radially and non-rotatably about the base member above the platens. A first print head is mounted in a vertically pivotable manner and a second print head is mounted in a non-pivotable manner.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

Throughout the drawings, like parts are indicated by like element numbers.

DETAILED DESCRIPTION OF THE PREFERRED EMBODIMENT

The following description of the preferred embodiment(s) is merely exemplary in nature and is in no way intended to limit the invention, its application, or uses. For clarity and simplicity of the figures, not all elements are shown in all figures.

Figure 1:
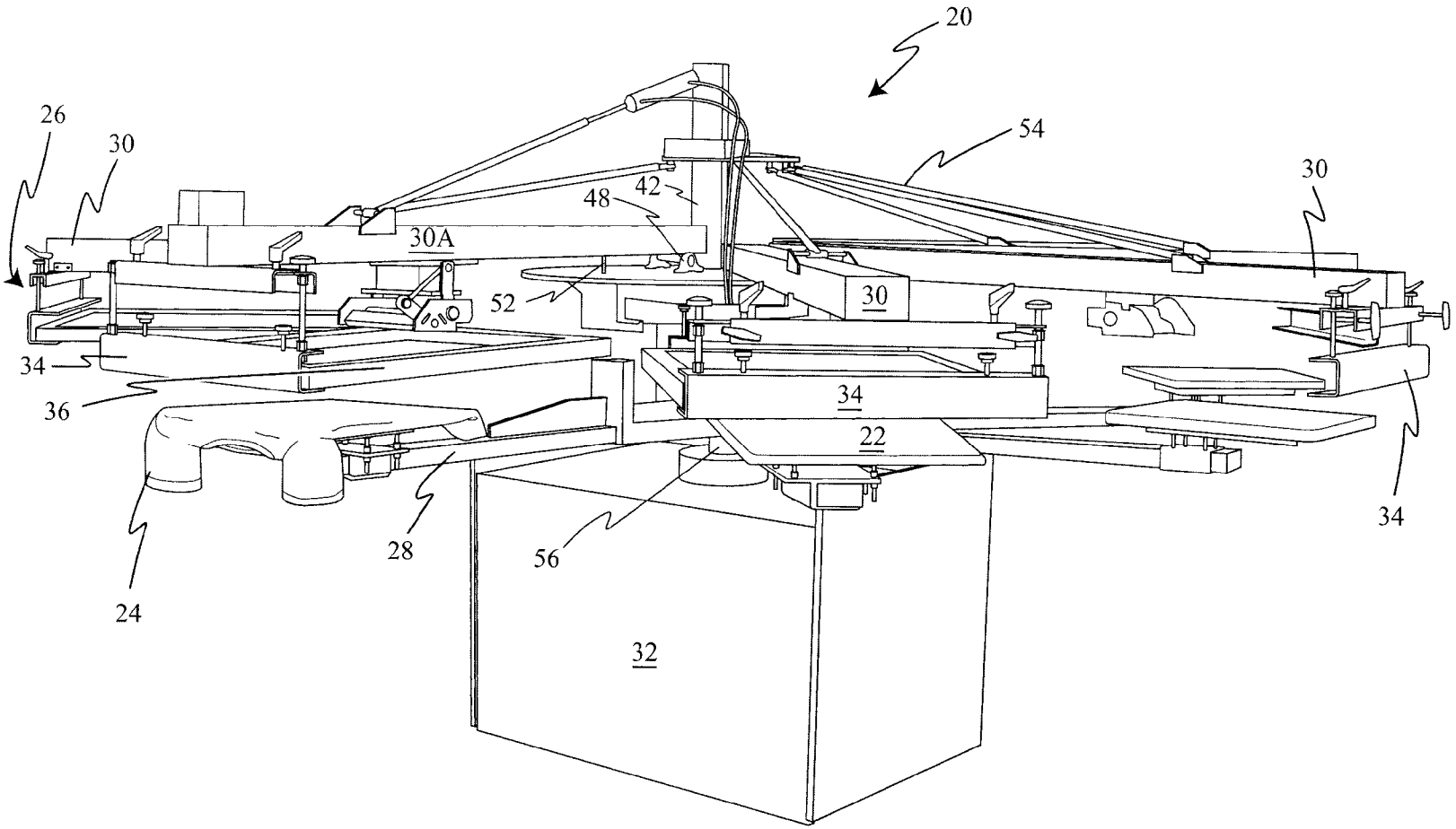
FIG. 1 is a perspective view of a multi-station screen printing machine of generally known variety, but with a new, equalizing print station attached thereto.
Figure 6:
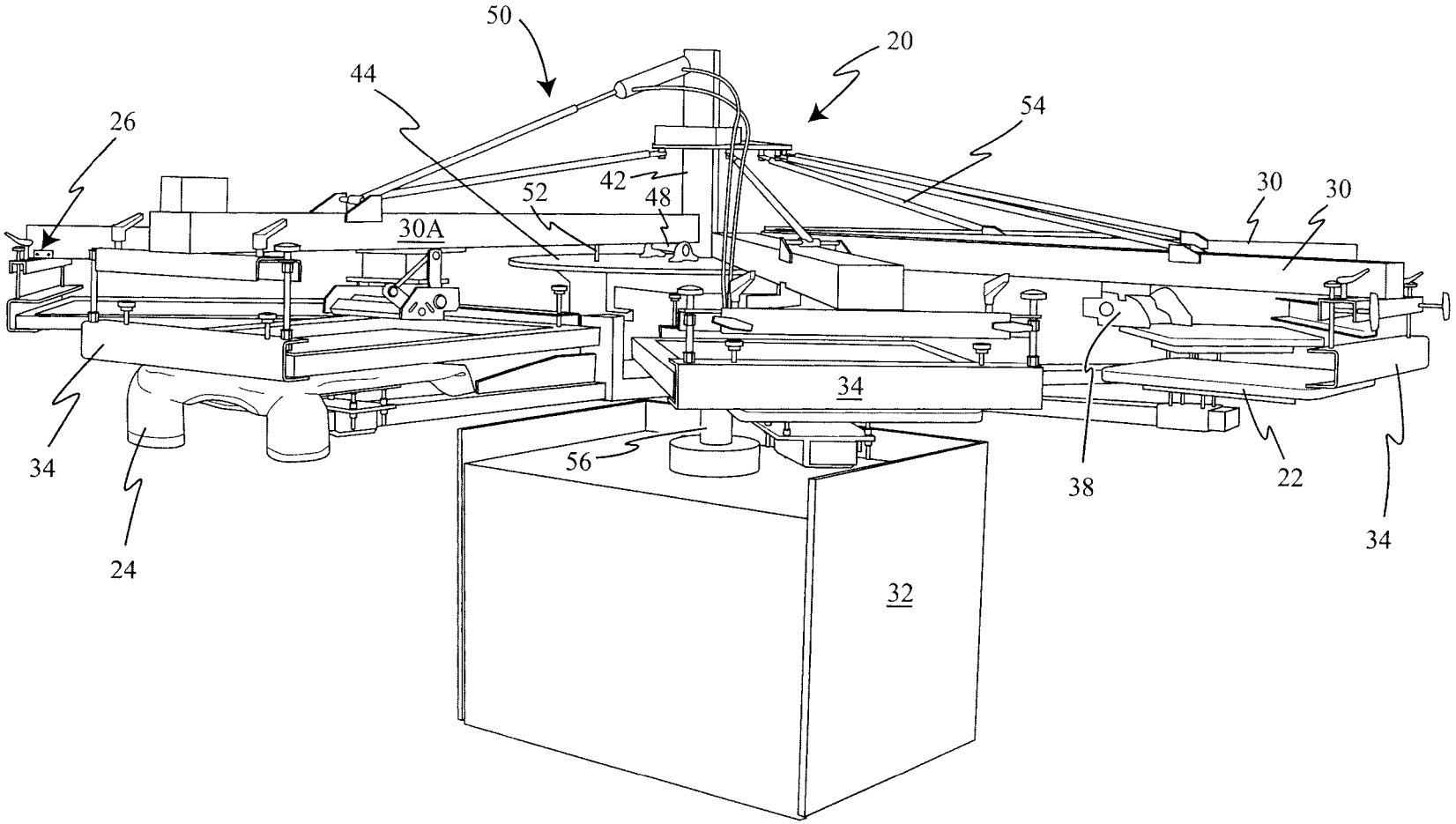
FIG. 6 is a perspective view of the multi-station screen printing machine of FIG. 1 having the pivoting print head support arm in the down position, wherein the platens are in the raised position for printing.
Figure 7:
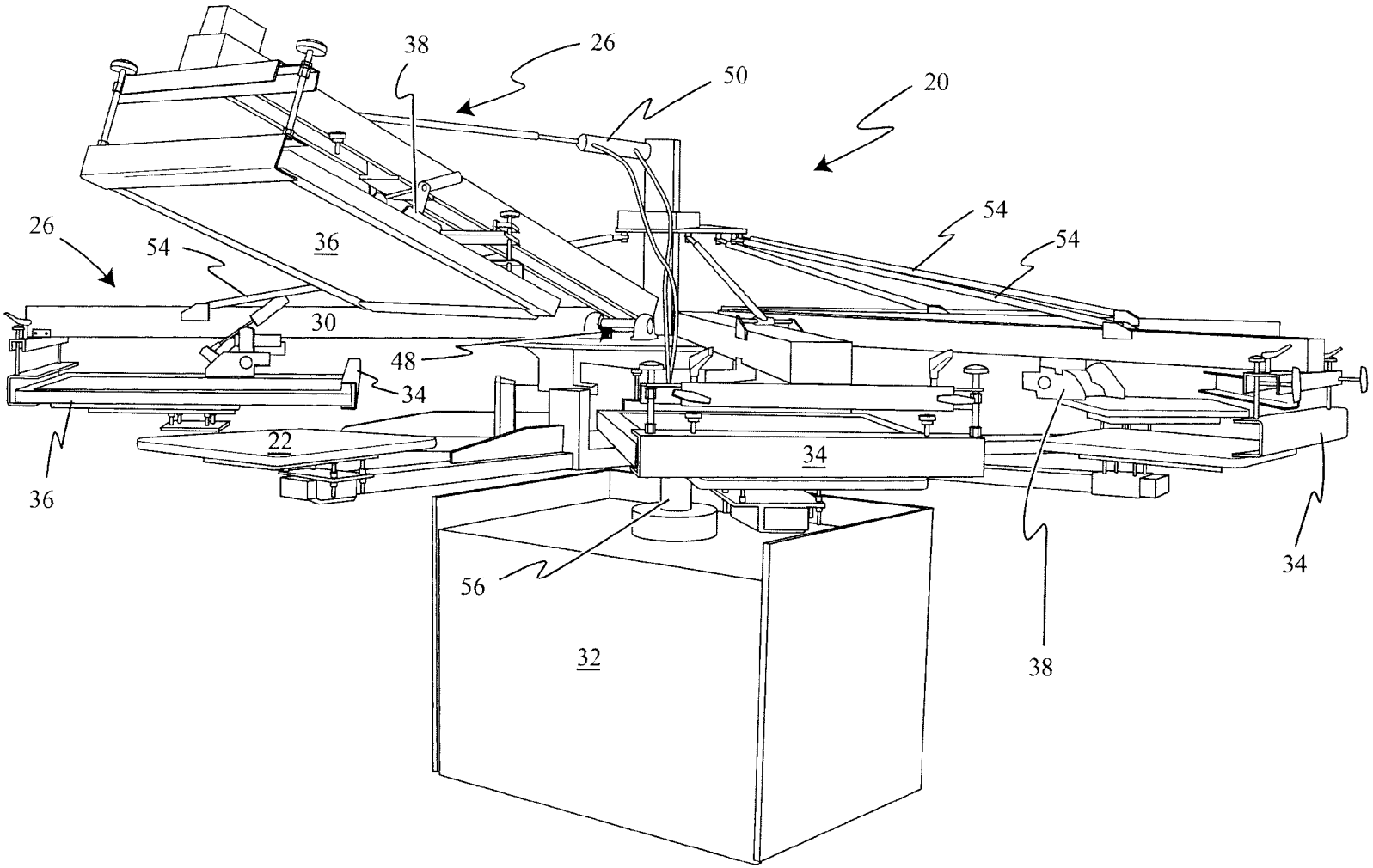
FIG. 7 is a perspective view of a multi-station screen printing machine of FIG. 1 having a pivoting print head support arm in the up position for removal of the substrate, wherein the platens are still in the raised position for printing.

As illustrated in the figures, and particularly FIGS. 1, 6 and 7, a multi-station screen printing machine, generally designated 20, has disposed around the perimeter thereof a plurality of platens 22, each for supporting a substrate article 24 to be printed, and a plurality of print heads 26 for screen printing a number of individual colors of a design onto the substrate article 24. Platens 22 and print heads 26 are mounted on support arms 28, 30, respectively, that project radially from a common, substantially central area disposed on machine (press) 20, such that print heads 26 are positioned above platens 22 during printing. Platens 22 are rotatably mounted to a base unit 32 while print heads 26 are mounted in a non-rotatable manner to the base unit 32. At the distal ends of the platen support arms 28 are disposed flat surfaces, i.e. the platens 22 themselves. At the distal ends of print head support arms 30 are the components which together make up print heads 26, including frame carriers 34 for holding printing screens 36, slidable holders 38 (shown in FIG. 4) for the squeegees, and various tubing for adding and removing ink to the screen in a conventional manner.

Figure 2:
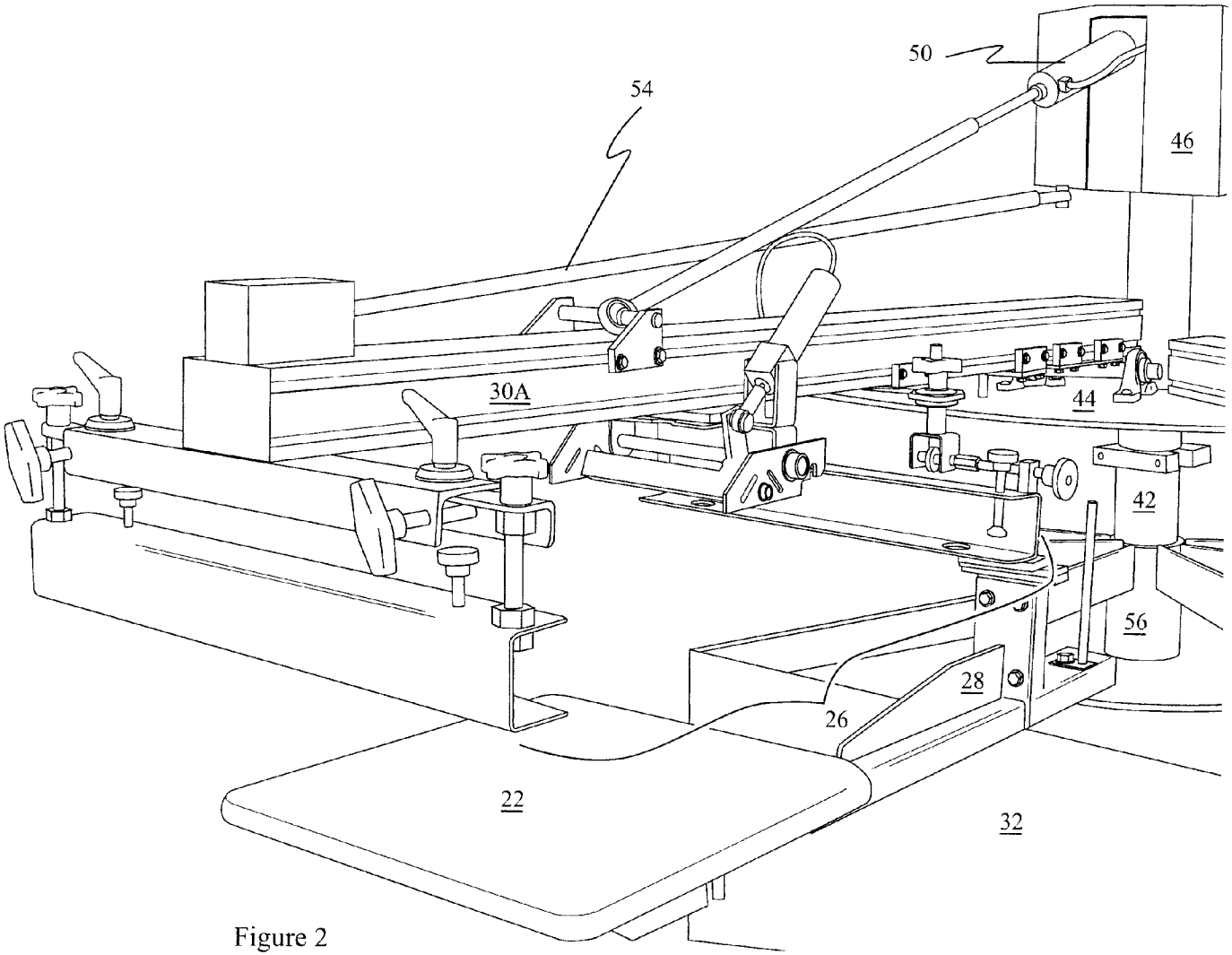
FIG. 2 is an enlarged perspective view of a portion of FIG. 1 showing a pivoting print head support arm with a print head attached thereto.
Figure 3:
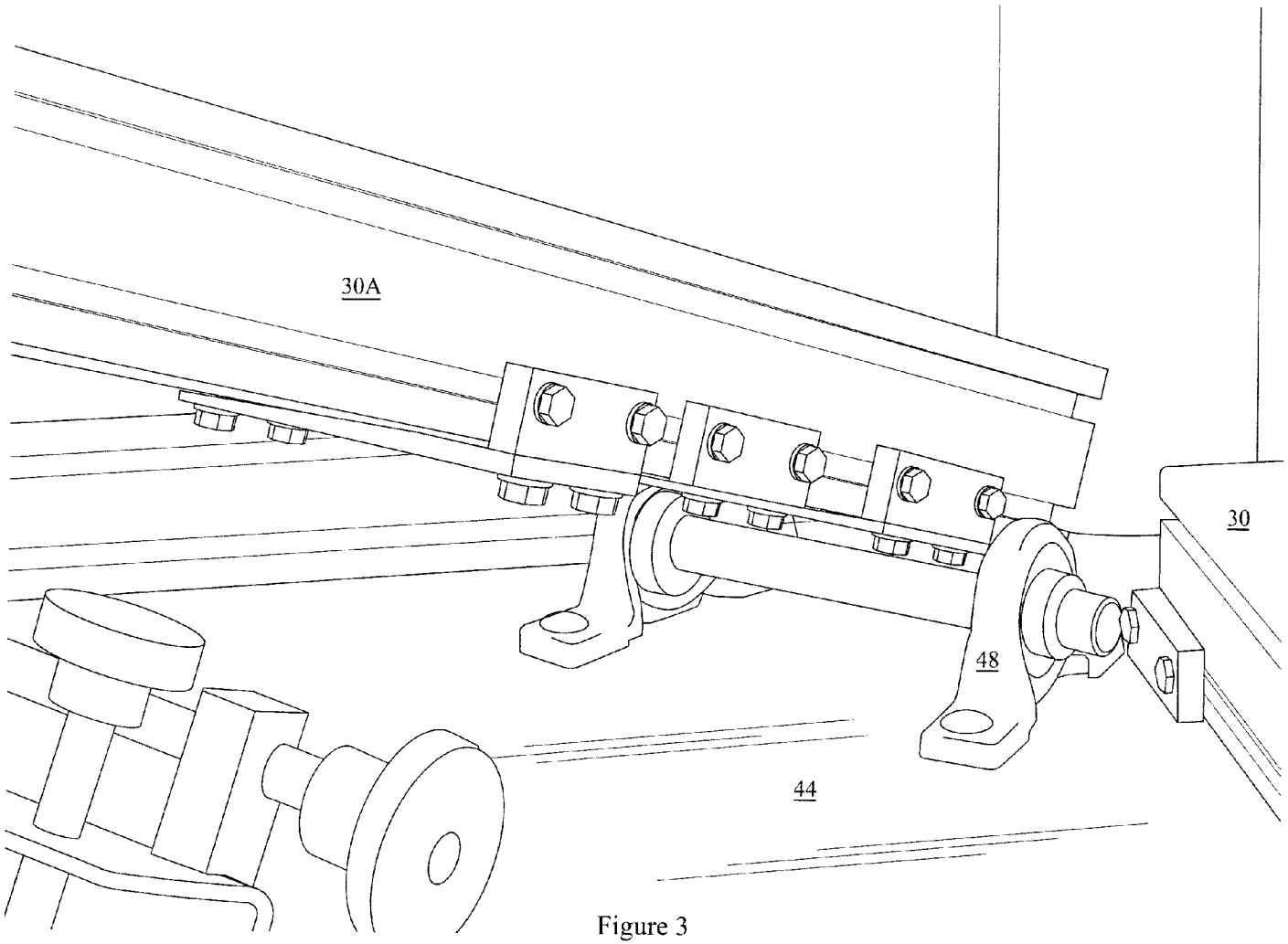
FIG. 3 is an enlarged perspective view of a hinge mechanism for attaching the pivoting print head support arm to a base unit of the printing machine of FIG. 1.
Figure 4:
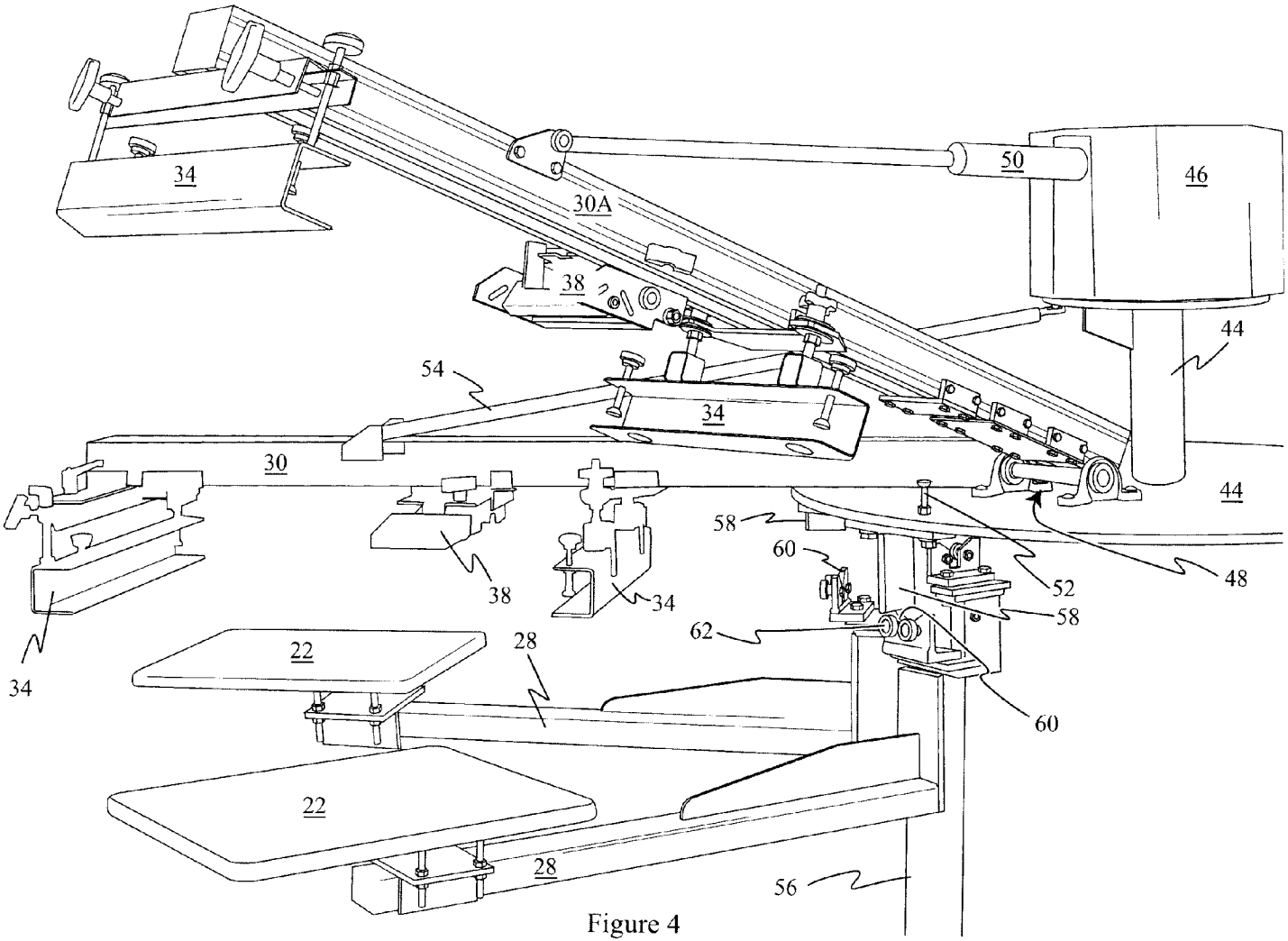
FIG. 4 is a perspective view of a portion of the screen printing machine of FIG. 1 with the pivoting print head support arm in the raised position.

Print heads 26 are attached to base unit 32 by a central shaft 42, with print head support arms 30 being attached to a circular plate 44, above which projects a tower 46, as seen in FIG. 2. In a preferred embodiment at least one, but fewer than all, of the print head support arms is pivotably mounted to circular plate 44 such that pivoting print head support arm 30A moves in a vertical plane, as circular plate 44 is raised and lowered in known fashion. Pivoting print head support arm 30A is held onto circular plate 44 by a hinge 48, for example, as shown most clearly in FIG. 3. The movement of pivoting print head support arm 30A is preferably, effected by an air-driven piston 50 or by mechanical means such as a motor. As shown in FIG. 4, air-driven piston 50 is attached to tower 46 and to pivoting print head support arm 30A, such that piston 50 raises and lowers the support arm 30 and the print head 26 associated therewith. Alternatively, pivoting print head support arm 30A can be raised and lowered manually.

Figure 5A:
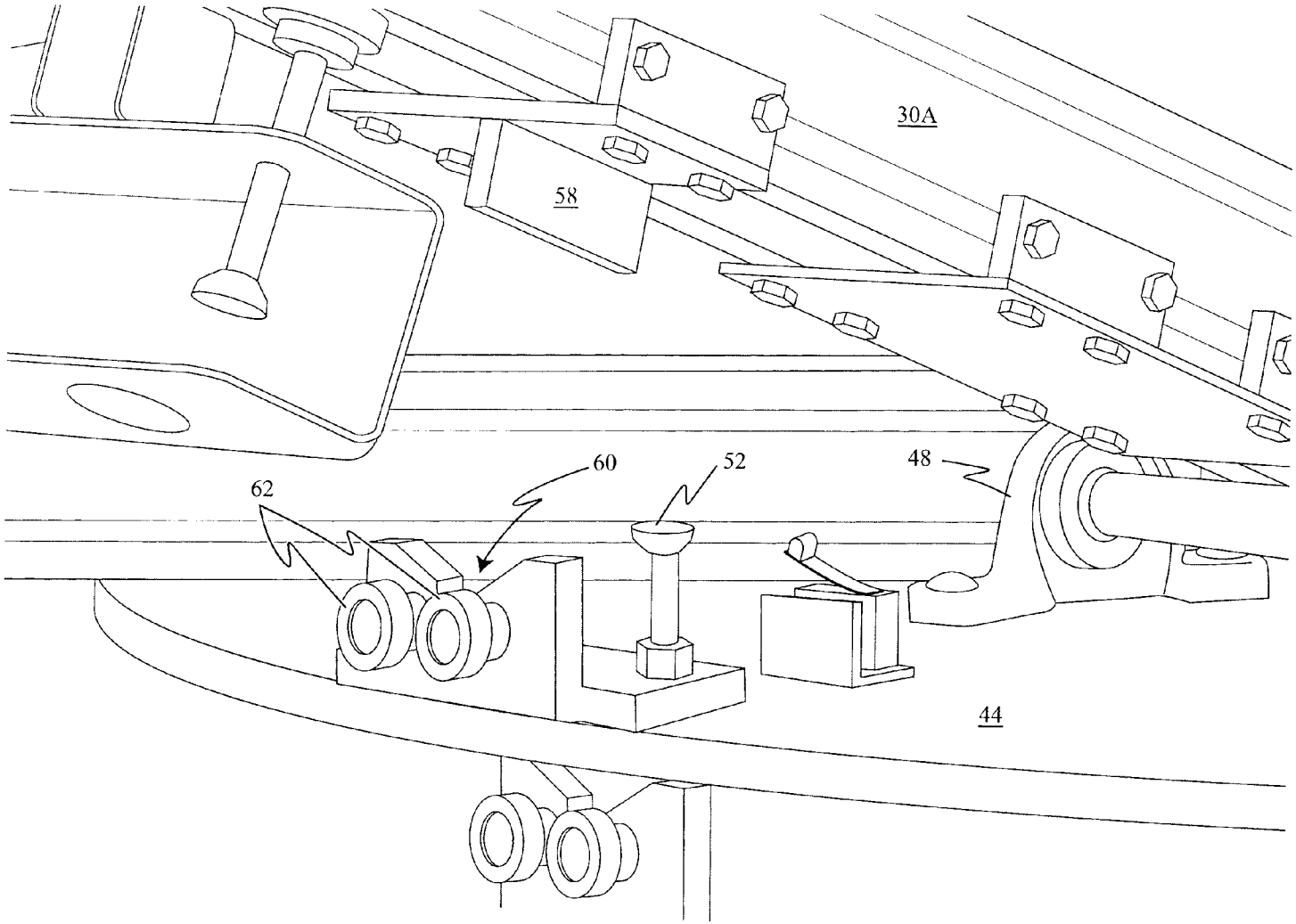
FIG. 5A is an enlarged perspective view of the alignment mechanism on a pivoting print head support arm of the printing machine of FIG. 1 in the raised position.

FIG. 5A shows that an adjustment device (or "stop") 52 such as a screw, for example, can be situated on the circular plate 44 below the pivoting print head support arm 30A to allow fine tuning of the final resting height of the pivoting arm in the lowered position. Pivoting print head support arm 30A preferably can be raised to an angle of at least 25-30 degrees relative to horizontal with the result that the distal edge of associated print head 26 is raised approximately 23 inches from a corresponding one of platens 22, giving ample room for adding or removing the substrate article 24 on or from such corresponding platen 22.

Remaining, non-pivoting print head support arms 30 can be stabilized by attachment of a support bar 54 between respective support arm 30 and tower 46, as shown in FIG. 1. In addition, various wires and tubing are fed through tower 46 to individual print heads 26, as necessary for operation of the printing functions.

FIG. 2 illustrates platen support arms 28 fixedly attached to a lifting tube 56 which in turn is slidably mounted on central shaft 42. Through conventional hydraulic, mechanical, or air-driven mechanisms. Lifting tube 56 is urged upwardly in order to bring platens 22 in close proximity beneath corresponding print heads 26 for printing purposes. In this embodiment, therefore, all of platen support arms 28 are raised and lowered in unison when lifting tube 56 is raised and lowered.

The process of screen printing is outlined briefly as follows and as shown in FIGS. 1, 6, 7. Print head 26 containing a screen 36 and platen 22 containing a substrate 24 (a shirt, jacket, or poster, for example) are aligned adjacent to one another and brought into close contact by raising platen 22 (FIG. 6). Ink is flooded onto screen 36 so that ink flows through screen 36 according to the design therein onto substrate 24, and then excess ink is removed using a squeegee mechanism that moves across screen 36. Print head 26 and platen 22 are then separated from one another, for example by lowering platen 22, as shown in FIG. 1, and either substrate 24 is then removed or platen 22 is rotated and aligned with another print head 26 and the process is repeated for each print head 26 that contains a different color in the ultimate design.

Print heads 26 are disposed above platens 22 so that ink does not spill when screen 36 is flooded and so that ink flows through screen 36 and onto substrate 24. On some existing machines the print heads remain in a fixed position while the platens rotate, while on at least one other the print head(s) are mounted on pivoting arms that cause the print heads to rotate upwards away from the platens. Heretofore, however, these two very different styles of print heads, i.e. 1) fixed and 2) pivoting, have not been combined on a single machine. One reason this has not been done before is because pivoting heads in general are disfavored in the market due to a perception that they do not align as accurately with the platen as fixed printing heads; thus causing sloppy printing and a less than desirable end product. Furthermore, the mechanisms for operating pivoting heads are very different from fixed head machines, creating a basic incompatibility between the two types of systems.

Figure 5B:
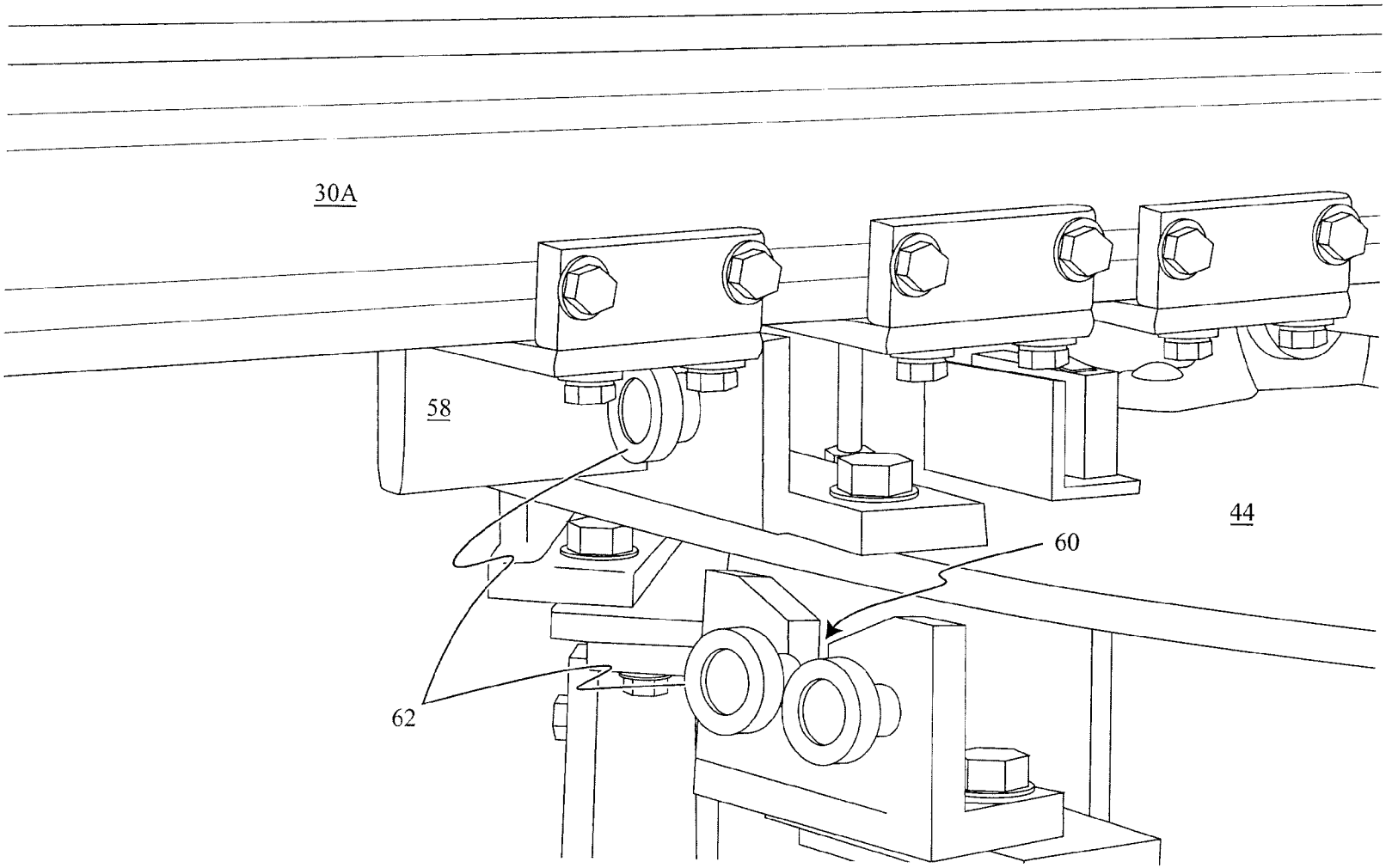
FIG. 5B is an enlarged perspective view of the alignment mechanism on a pivoting print head support arm of the printing machine of FIG. 1 in the lowered position.

Thus, an important issue regardless of the type of machine used is maintaining proper alignment between the different color screens when the platens or print heads are rotated to new positions. Even small amounts of mis-alignment will cause noticeable defects in the final printed image. Therefore, as seen in FIGS. 4, 5A, and 5B, in the new device an alignment tab 58 is used to maintain proper alignment between the screens of the various pivoting and non-pivoting print heads. Alignment tab 58 slides into a slot 60 that is bordered by a pair of rollers 62, which help guide vertical movement of alignment tab 58 and permit smooth movement the tab into and out of slot 60. In the embodiment illustrated, alignment tab 58 is mounted on the underside of pivoting print head support arm 30A and slot 60 is mounted in a corresponding position on top of circular plate 44, although other acceptable locations can be conceived. Provided that alignment tab 58 is relatively close to slot 60, rollers 62 will guide tab 58 into the slot and thus will provide appropriate side-to-side alignment of pivoting print head support arm 30A.

Similarly, as seen in FIG. 4, alignment tabs 58 are mounted to the underside of circular plate 44 beneath each non-pivoting print head support arm 30 and complementary slots 60 with rollers 62 are mounted near the base of each platen support arm 28. Alignment tabs 58 and slots 60 in this case help to properly align all platens 22 with print heads 26 for printing.

It is also possible to modify an existing machine to add one or more pivoting print head support arms 30A having print heads 26 such as those described above. In that case, one end of support arm 30A must be pivotably anchored, for example via a hinge mechanism 48, near the center of printing machine

20. If the machine to be so retrofitted is similar to the one described above, a hinge 48 attached to pivoting print head support arm 30A can be anchored to the circular plate 44 to which the other print head support arms 30 are fixed. In addition, a mechanism (e.g. a piston 50) for lifting the pivoting support arm 30A, if automatic or semiautomatic operation is desired, is attached to support arm 30A and to tower 46. Finally, tubing and wiring are attached to supply ink and to control operation of print head 26 in the customary manner.

As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A multi-station screen printing apparatus, comprising:

a base member;

a plurality of platens, each for supporting a substrate to be printed, the platens mounted radially in a rotatable manner about the base member; and a plurality of print heads mounted radially and non-rotatably about the base member above the platens;

wherein a first print head is mounted in a vertically pivotable manner and a second print head is mounted in a non-pivotable manner.

2. The screen printing apparatus of claim 1 wherein the total number of print heads is equal to the total number of platens.

3. The screen printing apparatus of claim 2 further comprising a piston operably coupled to the first print head to facilitate raising and lowering the first print head in a vertically pivotable manner.

4. The screen printing apparatus of claim 3 wherein the first print head is hingedly attached to the base member.

5. The screen printing apparatus of claim 4 further comprising an adjustment device for adjusting a resting height of the first print head when the first print head is in its lowest position.

6. The screen printing apparatus of claim 1, and further comprising a support arm, the support arm providing a structure for mounting the first print head.

7. The screen printing apparatus of claim 6, wherein the support arm has a first end and a second end, the first end being pivotably connected to the base of the apparatus and the second end for mounting the first print head.

8. The screen printing apparatus of claim 7 further comprising:

an alignment tab attached to and depending from the pivoting support arm; and a slot for receiving the alignment tab, wherein the slot is disposed below the pivoting support arm, such that the alignment tab is received into the slot when the pivoting support arm moves downward.

9. The screen printing apparatus of claim 8 further comprising rollers disposed adjacent opposite sides of the slot, such that the rollers guide the alignment tab into the slot.

10. The multi-station screen printing apparatus of claim 1, wherein the first print head is retrofit to operatively connect to a known multi-station screen printing apparatus.

11. A method of screen printing, comprising:

providing a multi-station screen printing apparatus having a plurality of platens for supporting a substrate to be printed, the platens mounted radially and rotatably around a base member; and a plurality of print heads mounted radially around the base member above a level of the platens; wherein the number of print heads is equal to the number of platens; wherein a first print head has a first screen mounted in a vertically pivotable manner and a second print head is mounted in a non-pivotable manner;

mounting a substrate on each platen;

raising the platens to meet the print heads;

lowering the platens away from the print heads;

rotating the platens so that each is aligned beneath a different print head;

pivotably raising the first print head to permit access to a first platen which is below the first print head;

removing a first substrate article from the first platen;

placing a second substrate article on the first platen; and pivotably lowering the first print head.

12. A multi-station screen printing apparatus, comprising:

a plurality of platens, each for supporting a substrate to be printed, the platens mounted radially in a rotatable manner about a base member;

a plurality of print heads mounted radially about the base member at a level above the platens, wherein the number of print heads is equal to the number of platens, wherein a first print head is mounted in a vertically pivotable manner and a second print head is mounted in a non-pivotable manner, wherein the first print head is hingedly attached to the base member;

a piston operably coupled to the first print head to raise and lower the first print head in a vertically pivotable manner; and an adjustment device for adjusting a resting height of the first print head when the first print head is in its lowest position.

* * * * *